United States Patent [19]

Seragnoli et al.

[11] Patent Number: 4,531,629

[45] Date of Patent: Jul. 30, 1985

[54] AXIAL TRANSLATION DEVICE FOR PARTLY FINISHED CIGARETTES

[75] Inventors: Enzo Seragnoli; Riccardo Mattei; Gastone Dall'Osso, all of Bologna, Italy

[73] Assignee: G.D Societa' per Azioni, Bologna, Italy

[21] Appl. No.: 472,561

[22] Filed: Mar. 7, 1983

[30] Foreign Application Priority Data

Mar. 29, 1982 [IT] Italy ..... 48120 A/82

[51] Int. Cl.[3] ..... B65G 47/26

[52] U.S. Cl. ..... 198/458; 131/282

[58] Field of Search ..... 198/458, 450, 480, 951; 131/282, 283

[56] References Cited

U.S. PATENT DOCUMENTS

| | | | |
|---|---|---|---|
| 3,084,783 | 4/1963 | Morton et al. | 198/450 |
| 3,270,601 | 9/1966 | Schubert | 198/450 |
| 3,446,161 | 5/1969 | Oddy | 198/458 |
| 4,003,277 | 1/1977 | Oesterling | 198/450 |
| 4,167,995 | 9/1979 | Schumacher | 198/458 |
| 4,200,179 | 4/1980 | Hinz | 198/458 |
| 4,403,620 | 9/1983 | Joseph et al. | 131/283 |

FOREIGN PATENT DOCUMENTS

| | | | |
|---|---|---|---|
| 1298031 | 6/1969 | Fed. Rep. of Germany | 198/450 |

*Primary Examiner*—Joseph E. Valenza
*Assistant Examiner*—Kyle E. Shane
*Attorney, Agent, or Firm*—Marshall, O'Toole, Gerstein, Murray & Bicknell

[57] ABSTRACT

An axial translation device for partly finished cigarettes disposed alongside one another in such a way as to form two substantially parallel rows, the device being provided with an input conveyor, an output conveyor and a conveyor roller for each said row disposed between the said input conveyor and output conveyor and tangential thereto, the said two conveyor rollers having parallel, but non coincident axes and supporting the partly finished cigarettes of the associated said row in an axially movable manner under the thrust of actuator means.

6 Claims, 3 Drawing Figures

AXIAL TRANSLATION DEVICE FOR PARTLY FINISHED CIGARETTES

BACKGROUND OF THE INVENTION

The present invention relates to an axial translation device for partly finished cigarettes.

In particular, the present invention relates to a device which can cooperate with partly finished cigarettes disposed alongside one another and aligned in two substantially parallel rows fed by a transporter in a direction perpendicular to the axes of the partly finished cigarettes themselves.

The present invention can be advantageously utilised when, for any reason, the distance between the two rows of partly finished cigarettes must be varied such as, for example, in the case when it is required to insert a double filter between two partly finished cigarettes each aligned on a respective said row.

In general, it is known to effect axial displacement between partly finished cigarettes constituting the two adjacent rows mentioned above by utilising a single spacer conveyor on which the partly finished cigarettes of each row are lodged in sliding supports which are axially movable with respect to corresponding supports of the partly finished cigarettes of the other said row under the thrust of actuator means.

The known solutions described above, even though very simple from a structural point of view, involve significant difficulties when the said spacer conveyor is not accessible from both its axial ends because of its assembly position. In fact, in this case, it is very difficult for an operator to perform any control operations and, above all, to undertake maintenance of the slide supports disposed adjacent to that end of the said spacer roller which is inaccessible.

SUMMARY OF THE INVENTION

The object of the present invention is that of providing an axial translation device for partly finished cigarettes which will be free from the above described disadvantage.

The said object is achieved by the present invention in that it relates to an axial translation device for partly finished cigarettes arranged alongside one another in such a way as to form two substantially parallel rows movable in a direction of advance substantially perpendicular to the axes of the said partly finished cigarettes; the device including an input conveyor and an output conveyor for the said two rows of partly finished cigarettes, axial translation means for the said partly finished cigarettes being provided between the said input conveyor and the said output conveyor to vary the distance between the said two rows, characterised by the fact that the said axial translation means include two conveyor rollers each operable to transport partly finished cigarettes of a respective said row and rotatable about respective axes parallel to those of the said partly finished cigarettes but offset from one another; each said roller being substantially tangential to the said input and output conveyors and carrying, connected to their periphery, a plurality of supports for the said partly finished cigarettes; the said supports being movable parallel to the axis of the partly finished cigarettes under the thrust of actuator means between an axial take-up position and an axial release position.

BRIEF DESCRIPTION OF THE DRAWINGS

Further characteristics and advantages of the present invention will become apparent from the following description with reference to the attached drawings, which illustrate a non limitative embodiment thereof, in which.

DETAILED DESCRIPTION OF THE INVENTION

Figure 1:
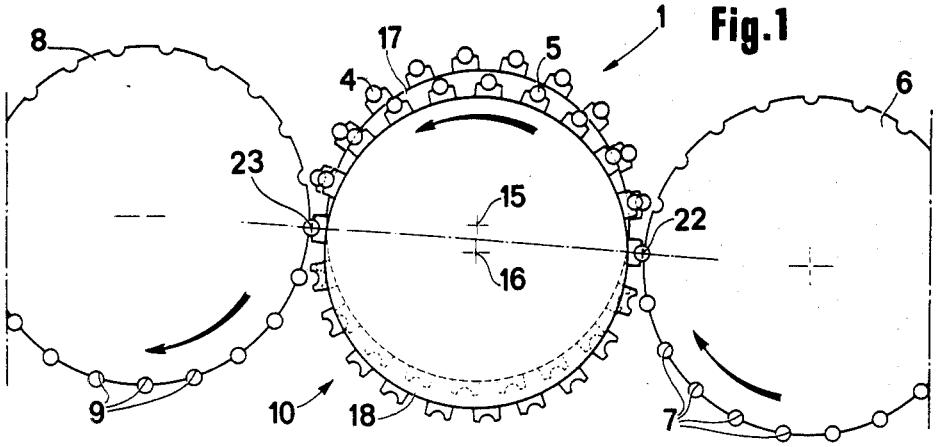
FIG. 1 is a schematic side view of an axial translation device formed according to the principles of the present invention.
Figure 2:
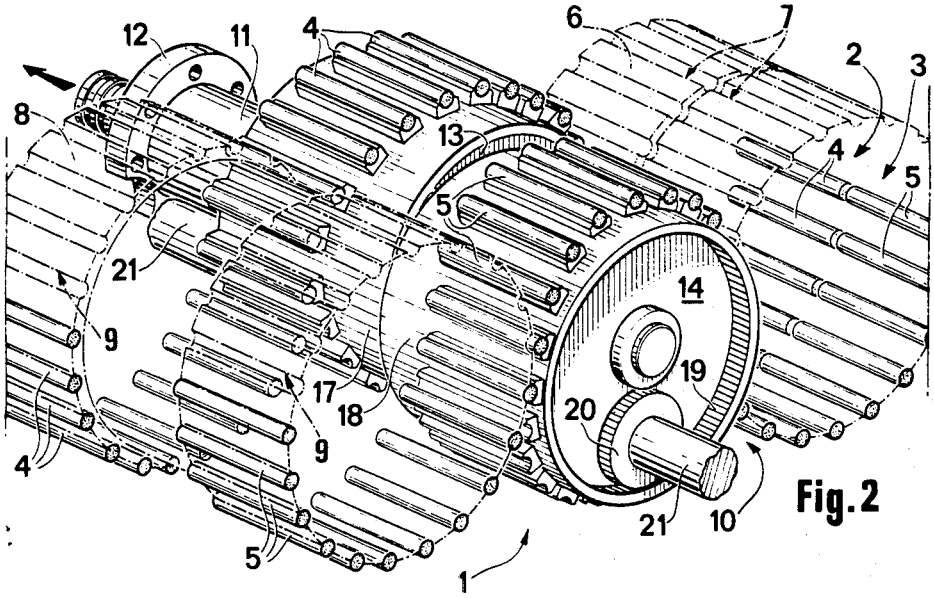
FIG. 2 is a schematic perspective view of the device of FIG. 1.

In FIGS. 1 and 2 there is illustrated a translation device generally indicated 1 and operable to convey along predetermined paths two rows 2 and 3 formed of partly finished cigarettes respectively indicated 4 and 5 disposed laterally alongside one another and substantially perpendicular to a direction of advance.

The device 1 includes an input conveyor 6 constituted by a single roller having along its periphery two rows of uniformly distributed axial grooves 7, an output conveyor 8 constituted by a single roller the axis of which is parallel to that of the roller 6 and having around its periphery two rows of axial grooves 9 similar to the grooves 7, and an axial translation device generally indicated 10 and interposed between the conveyors 6 and 8. In the illustrated example each groove 7,9 on both the roller 6 and on the roller 8 is aligned with a corresponding groove 7,9 of the other row of grooves.

Figure 3:
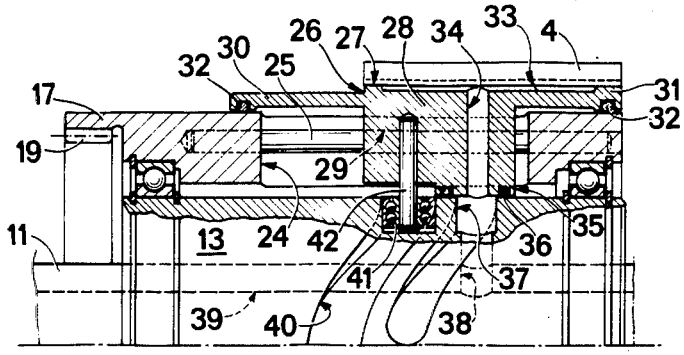
FIG. 3 is an axial section, and on an enlarged scale, of a detail of FIGS. 1 and 2.

As illustrated, in particular in FIGS. 2 and 3, the axial translation device 10 includes a central hollow shaft 11 having a flange 12 for attachment to a fixed support not illustrated. The shaft 11 carries two cylindrical supports 13 and 14 keyed thereto, the axes of which, respectively indicated 15 and 16 (FIG. 1) are parallel, but not coincident, with one another and parallel to the axes of the rollers 6 and 8. In particular, at least one of the axes 15 and 16 does not coincide with the axis of the shaft 11. The two cylindrical supports 13 and 14 rotatably support respective conveyor rollers 17 and 18, each of which has an inner toothing 19 meshing with a respective cylindrical sprocket 20 keyed onto a drive shaft 21.

As illustrated in FIG. 1, the outer periphery of each roller 17 and 18 is disposed substantially tangentially to the outer periphery of the rollers 6 and 8 along generatrices 22 and 23 of these latter.

Since the rollers 17 and 18 are substantially identical, in the following description only the roller 17 will be described with reference to what is illustrated in FIG. 3.

The roller 17 has a plurality of axial slits 24 uniformly distributed around its periphery and each housing within it a fixed guide rod 25 disposed parallel to the axis 15 and serving as a sliding guide for an associated slide 26. This latter has an outer axial groove 27 which, together with the associated slide 26, constitutes a support for an associated partly finished cigarette 4. Each slide 26 has a central body 28 slidably inserted into the associated slot 24 and having an axial hole 29 slidably engaged by the associated rod 25. From the axial end opposite the body 28 extend two axial arms 30 and 31 which cooperate with the outer surface of the roller 17 by means of the interposition of sliding and sealing members 32.

During its transfer from the roller 17 each partly finished cigarette 4 is retained within the associated groove 27 by a vacuum or suction which is obtained by means of a groove 33 formed axially in the bottom of the associated groove 27 and communicating with a radial through hole 34 formed through the body 28. This latter has an inner radial projection 35 traversed by the end of the associated hole 34 and coupled slidably to the outer surface of the cylindrical support 13 with the interposition of a sealing washer 36.

The inner end of each hole 34 is able to communicate with a groove 37 formed along the periphery of the cylindrical support 13 around an arc at least equal to the arc along which the partly finished cigarettes 4 are made to advance between the generatrices 22 and 23. The grooves 37 communicate via a hole 38 formed radially in the cylindrical support 13 with an axial hole 39 of the shaft 11 in turn connected to a suction source not illustrated.

On the outer periphery of the cylindrical support 13 is formed an annular cam groove 40 which is engaged slidably by a cam follower roller 41 rotatably supported by a pin 42 extending radially inwardly from the inner end of the body 28. As illustrated in FIG. 3, the groove 40 is shaped in such a way as to impart a reciprocating movement to the slides 26 along the associated rods 25 during the rotation of the roller 17 around its axis. In order to ensure full and free communication between the hole 34 and the groove 37 at all points of the said transportation arc, and at the same time render the axial dimensions of the cylindrical support 13 as small as possible, the groove 37 is shaped in a similar manner to that of the groove 40 to which it is parallel at all points.

In use, the partly finished cigarettes 4 and 5 which advance along the input conveyor 6 maintained in the associated grooves 7 by a suction system or systems not illustrated are released to the rollers 17 and 18 when they arrive at the generatrix of tangency 22. In this position the suction ceases and the partly finished cigarettes 4 and 5 are released by the input conveyor 6 to the rollers 17 and 18 respectively, which receive them in the associated grooves 27 within which they are retained by the effect of the vacuum generated by suction through the groove 33.

The grooves 40 of the rollers 17 and 18 are formed in such a way as to impart a determined axial displacement to the slides 26 of the roller 17 with respect to the slides 26 of the roller 18. In the case where, for example, it is desired to insert an additional element such as a double filter between the facing ends of two corresponding partly finished cigarettes 4 and 5, the slides 26 of the rollers 17 and 18 perform, starting from the said axial take-up position, a relative separating displacement in such a way as to dispose the associated partly finished cigarettes 4 and 5 at the desired axial distance from one another upon traversing to a release position disposed in correspondence with the generatrix 23. In the release position the suction through the groove 33 ceases and the partly finished cigarettes 4 and 5 are transferred by suction to the interior of the groove 9 of the output conveyor 8 at an axial distance from one another different from that which they had on the input conveyor 6.

In the illustrated embodiment each of the conveyors 6 and 8 is tangential to the rollers 17 and 18 along a single respective generatrix 22, 23; in variants not illustrated the rollers 17 and 18 could on the other hand be tangential to the input conveyor 6 and/or to the output conveyor 8 along non coincident generatrices.

In the illustrated embodiment the arcs of transport along which the partly finished cigarettes 4 and 5 are made to advance by the rollers 17 and 18 between the generatrices 22 and 23 are different and, in particular differ from one another by an amount equal to at least one pitch or distribution step of the grooves 27 or to a multiple of this distance. In other variants the said arcs can be equal to one another. In this case, not illustrated, the rollers 17 and 18 necessarily have different diameters and are tangential to the conveyors 6 and 8 along respective different generatrices. Given the offset disposition of the two rollers 17 and 18 in all the embodiments of the device in question considered, it is possible for an operator to easily reach the slides 27 disposed along the said arc of transport acting from a single side of the device 1.

We claim:

1. A device for axial translation of partly finished cigarettes (4,5) disposed alongside one another in such a way as to form two substantially parallel rows (2,3) movable in a direction of advance substantially perpendicular to the axes of the said partly finished cigarettes (4,5); the device including an input conveyor (6) and an output conveyor (8) for the said two rows of partly finished cigarettes (4,5) and axial translation means (10) for the said partly finished cigarettes (4,5) being provided between the said input conveyor (6) and output conveyor (8) to vary the distance between the said two rows (2,3); characterized by the fact that the said axial translation means (10) include two conveyor rollers (17,18) each operable to transport partly finished cigarettes (4,5) of a respective said row (2,3) and rotatable about respective axes (15,16) parallel to those of the said partly finished cigarettes (4,5) but offset from one another; each said roller (17,18) being substantially tangential to the said input and output conveyors (6,8) and carrying connected to their peripheries a plurality of supports (26,27) for the said partly finished cigarettes (4,5); the supports (26,27) being movable parallel to the axes of the said partly finished cigarettes (4,5) under the thrust of actuator means (40,41,42) between a take-up position and a release position, the said supports (26,27) for the said partly finished cigarettes (4,5) being distributed at constant pitch around the periphery of the said conveyor rollers (17,18), and with the distances along the periphery of these rollers lying between their points of tangency with the said input and output conveyors (6,8) and differing from one another by an amount equal to at least one pitch step, and the input conveyor (6), the output conveyor (8) and the conveyor rollers (17,18) all having the same pitch or distribution step and the distances along the periphery of the conveyor rollers (17,18) between the point of tangency with the input conveyor (6) and output conveyor (8) differing by an amount which is exactly equal to one pitch or distribution step or a multiple of this distance.

2. A device according to claim 1, characterised by the fact that the said two conveyor rollers (17,18) are disposed in such a way as to be substantially tangential to the said input conveyor (6) along substantially coincident generatrices.

3. A device according to claim 1 characterised by the fact that the said two conveyor rollers (17,18) are disposed in such a way as to be substantially tangential to the said output conveyor (8) along substantially coincident generatrices.

4. A device according to claim 1, characterised by the fact that the said two conveyor rollers (17,18) are mounted rotatably about respective cylindrical supports (13,14) mounted on a single central axis, at least one of the said cylindrical supports (13,14) being offset with respect to the said central axis.

5. A device according to claim 4, characterised by the fact that each said cylindrical support (13,14) has an external annular cam groove (40); each said support (26,27) for partly finished cigarettes including a slide (26) axially slidably mounted on the periphery of the associated said conveyor roller (17,18) and provided with a cam follower (41) slidably coupled to the said cam groove (40).

6. A device according to claim 5, characterised by the fact that each said partly finished cigarette support (26,27) is provided with vacuum means for retaining the associated partly finished cigarettes (45); the said vacuum means communicating with a vacuum source through a groove 37 extending over a predetermined arc around the associated said cylindrical support (13,14) parallel to the associated cam groove (40).

* * * * *